United States Patent [19]

Johnson

[11] 4,175,552

[45] Nov. 27, 1979

[54] VIBRATION DEVICE

[76] Inventor: Brian G. Johnson, 65 Wolfe Pl., Hillside, Del. 07205

[21] Appl. No.: 829,653

[22] Filed: Sep. 1, 1977

[51] Int. Cl.[2] ..... A61H 1/00

[52] U.S. Cl. ..... 128/32

[58] Field of Search ..... 128/32, 33, 26, 41, 128/24.1, 24.2, 24 R

[56] References Cited

U.S. PATENT DOCUMENTS

| | | | |
|---|---|---|---|
| 729,317 | 5/1903 | Fleetwood | 128/24 R |
| 2,520,172 | 8/1950 | Rubinstein | 128/24 R |
| 3,875,932 | 4/1975 | Wachspress | 128/24 R |
| 3,954,101 | 5/1976 | Wachspress | 128/24 R |

FOREIGN PATENT DOCUMENTS

| | | | |
|---|---|---|---|
| 958865 | 2/1957 | Fed. Rep. of Germany | 128/32 |
| 1086820 | 8/1954 | France | 128/32 |

*Primary Examiner*—Lawrence W. Trapp
*Attorney, Agent, or Firm*—Stuart E. Beck

[57] ABSTRACT

A vibration device which provides a soothing pleasurable sensation in response to the audio output from an electronic device such as a record player, tape player, television set or radio. The device includes a housing which supports a speaker. The speaker vibrates in response to a signal received from the audio output of the electronic device. The speaker is contained within a housing which vibrates in response to the vibrations of the speaker while muffling the sounds that it creates. A listener can place his hand on the housing and sense the vibrations. The device can be used in conjunction with an audible signal or without the audible signal.

5 Claims, 7 Drawing Figures

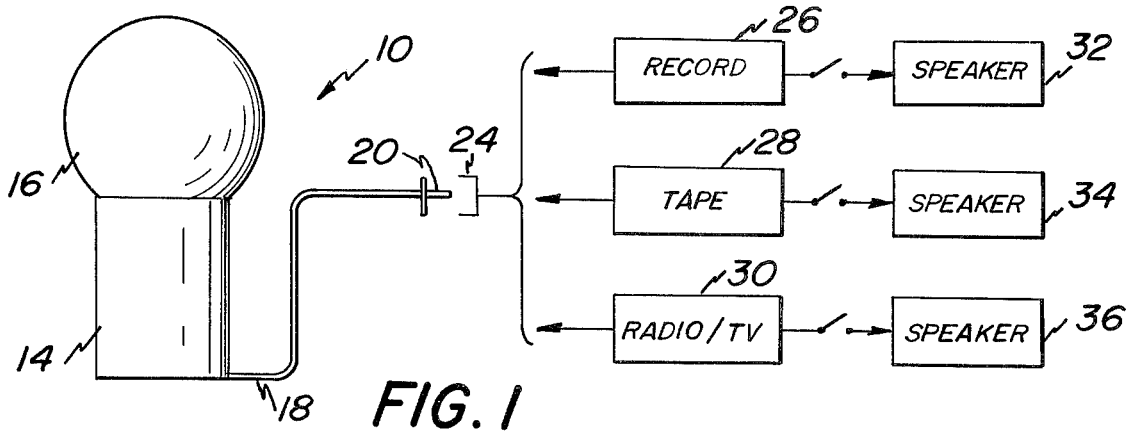
FIG. 1
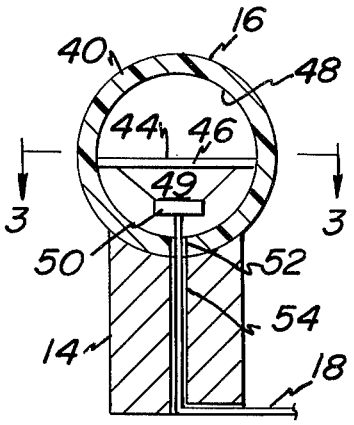
FIG.2
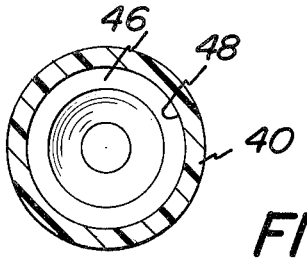
FIG.3
FIG.7
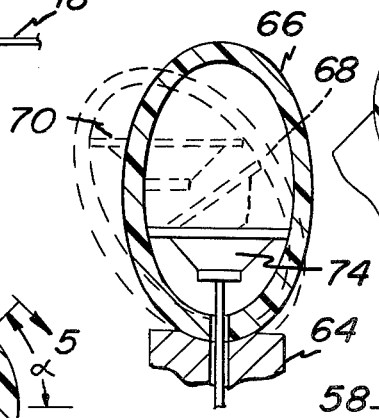
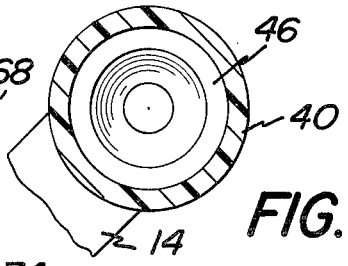
FIG. 5
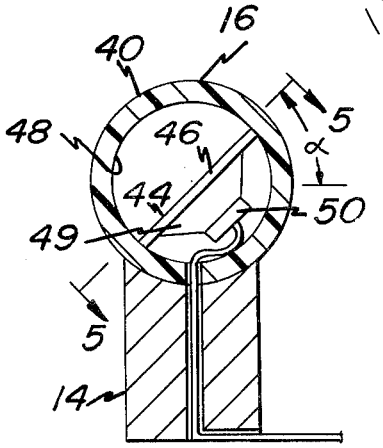
FIG. 4
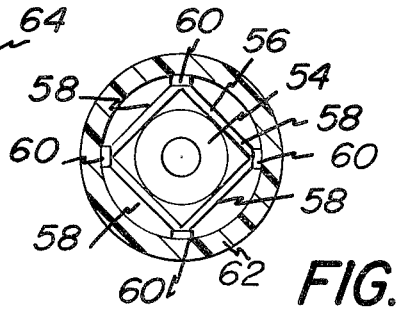
FIG. 6

VIBRATION DEVICE

This invention relates to a vibration device and more particularly to a device which vibrates in response to signals from the audio output of an electronic device.

It is known that vibrations may have a soothing and pleasurable effect on the body. The invention disclosed herein enables a person at home to enjoy the soothing and pleasurable effects of vibration while avoiding the monotony that occurs when using vibrators which are presently known. Further, as will be explained in greater detail herein, the physical sensations created by the vibrator can be enjoyed at the same time an audible signal which is generated by the audio output of an electronic device is heard with the vibrations being responsive to the frequency and intensity of the audio signal to maximize the effect. Additionally, the sound generator can be denergized so that no audible signal is heard while the vibrator vibrates in response to the frequency and intensity of the audio signal.

The vibrations which are created will be strong at times and weak at other times. Further their frequency will also vary. This variation will tend to make the vibrations interesting and soothing so that the pleasurable effects are maximized when compared to presently known vibrators which only vibrate at a limited number of predetermined intensities and frequencies, and which become monotonous and boring in a short period of time.

This is accomplished by providing a simple and inexpensive device which may be touched or held by a person while it is vibrating. The device vibrates in response to the audio signal generated by a record player, tape player, television set, radio or any other electronic means so that the intensity and frequency of the audio signal is transformed into vibrations which may be felt by a person using the device. It may be used in conjunction with an audible signal so that in addition to hearing the sounds which are created, the person using the device can also sense the vibrations.

Generally, the invention relates to a device for providing a pleasurable sensation when it is touched comprising a speaker and a housing for the speaker. The speaker is supported in the housing and is completely enclosed thereby. Means are provided for connecting the speaker to the audio output of a suitable electronic device so that the audio signals created by the device will cause the speaker to vibrate. The housing has a wall which is of sufficient thickness to muffle the sounds emanating from the speaker.

For the purpose of illustrating the invention, there is shown in the drawing forms which are presently preferred, it being understood, however, that the invention is not limited to the precise arrangements and instrumentalities shown and wherein:

FIG. 1 is a schematic drawing showing the manner in which a device constructed in accordance with the present invention may be connected to an electronic device having an audio output;

FIG. 2 is a vertical sectional view taken through one presently preferred embodiment of the invention;

FIG. 3 is a sectional view taken along line 3—3 of FIG. 2;

FIG. 4 is a vertical sectional view taken through another preferred form of the embodiment;

FIG. 5 is a sectional view taken along 5—5 of FIG. 4;

FIG. 6 is a sectional view similar to FIGS. 3 and 5 but showing still another preferred form of the invention and, FIG. 7 is a vertical sectional view showing still another preferred form of the invention.

Now referring to the drawings for a detailed description of the invention, a vibrating device 10 which comprises a base 14 and a housing 16 is shown in FIG. 1.

The vibrating device is connected by suitable means such as the cord 18 and plug-in jack 20 to a receptacle 24. The receptacle may be connected to the audio output circuitry of an electronic device such as a record player 26, a tape player 28 or a radio or television set 30 so that it receives a signal that is proportional to the signal that is generated for the speakers of the electronic device. For the purpose of the invention it makes no difference which of these devices is used, provided that it creates an audio output signal.

Referring to FIGS. 2 and 3 the housing 16 may be a hollow sphere having a wall 40 of substantial thickness. While the thickness of the wall and the material of which it is comprised are not critical, it should be appreciated that the wall thickness and the material of which it is comprised should be selected so as to completely muffle the sounds of the speaker 44 which is supported therein while permitting the housing to vibrate. Hard rubber has been found to be a suitable material for this purpose.

Speaker 44 is of conventional design. It includes a diaphram 46 which is connected by a cone 48 to an electromagnet 50. The electromagnet 50 is coupled to one end of cord 18. The cord extends through a small aperture 52 in the housing. The aperture and cord fit snugly together to maintain the sound-tight integrity of the housing. The diaphram 46 and cone 48 are surrounded and supported by rim 46.

As best seen in FIG. 3 the rim 46 may be an annulus and consequently, its entire periphery may be in engagement with the inner surface 48 of wall 40. While the rim is shown supported through the mid-portion of the housing 16, it is apparent that the precise location of the speaker within the housing is not critical and that different vibration effects will result from locating the speaker in different locations in the housing.

The housing 16 may be mounted on a base 14 so that it can be supported on a table or on the floor. In this regard, a suitable aperture 54 in the base 14 is in alignment with aperture 52 in the housing so that the cord 18 can extend from the speaker to the aforementioned audio output 24.

The device is operated by inserting jack 20 into the audio output 24 of any one of the record player, tape player, radio or television set 26–30. The speakers 32–36 of the respective devices can be energized to provide an audible signal if desired. As the audio output 24 receives audio signals, the speaker 44 will vibrate in a well known fashion in accordance with the intensity and frequency of the signals which it receives. Because the speaker is connected to the inner wall of the housing, the housing will also vibrate. However, because of the thickness of the wall 40 and the material of which it is made no sounds will emanate from it.

The device may be enjoyed by merely touching it or by resting the palms or fingertips on it while it is operating. The variations in frequency and intensity of the audio signal will be felt thereby providing a soothing and pleasurable sensation to the person using it.

Variations in the intensity of the vibration of the housing for a particular vibrations of the speaker can be achieved by designing the speaker so that it lies in various locations on the inside of the housing and by varying the shape of the speaker and housing. Thus, while the shape of the housing which has been illustrated is a sphere, it is apparent that other convenient shapes could be selected such as the egg-shape shown in FIG. 7 or the like. Further, the location of the speaker within the housing can be varied to achieve different vibration effects for particular sounds. Thus, while in FIG. 2 the speaker is located substantially along a horizontally positioned diameter, it is apparent that the speaker could be moved to a position where it lies below or above that diameter.

Further, referring to FIG. 4 it can be seen that the speaker 44 may be disposed at an angle with respect to the horizontal so that the vibrations on one portion of the housing 16 are different from the vibrations on another portion. In FIG. 6 a speaker 54 is shown supported by a rectangular housing 56 comprising a plurality of sides 58. A pad 60 of suitable resilient material such as foam or the like is connected to the juncture of adjacent sides 58 to transmit the vibrations from the speaker to the wall 62 of the housing. Additionally, the pads prevent sharp edges or burrs at the juncture of the sides 58 from damaging the housing.

In FIG. 7 an egg shaped housing 66 is shown supported on a base 64. A speaker 74 is supported within the housing in the same manner as the speakers described above. The speaker is shown below the mid-portion of the housing. However, as explained above it can be positioned at any convenient location in the housing and at any desired angle.

Further, the housing 66 can be angularly disposed on the base 64 as shown in phantom in FIG. 7 with the speaker also being disposed at an angle therein as shown at 68 or a speaker having an elliptical shape such as that shown at 70 can be employed.

Further, modifications and variations on the structure disclosed herein will be apparent to those skilled in the art in view of the preceding description. Thus, housing shapes and speaker shapes can be varied to achieve any desired result.

Still further, while the invention has been described in the context of including only one speaker in a housing, it is apparent that as many speakers as desired could be placed in a particular housing.

Thus while the invention has been described with respect to certain forms and embodiments thereof it is apparent that many other forms and embodiments will be obvious to those skilled in the art in view of the foregoing description. Thus, the scope of the invention should not be limited by the foregoing description, but rather, only by the scope of the claims appended hereto.

I claim:

1. A device for providing a pleasurable sensation when it is touched comprising a base, an audio speaker and a housing, said speaker including a circular rim comprised of rigid material, said housing comprising a hollow sphere supported on said base and completely enclosing said speaker with the entire periphery of said rim being in engagement with the wall of said housing to enable said housing to support said speaker and to enable the vibrations of said speaker to be transmitted to said wall to vibrate said wall, said wall being of sufficient thickness to muffle the sounds emanating from said speaker, an aperture in said wall, means for energizing said speaker, a portion of said last named means extending through said aperture and being in electrical connection with said speaker, another portion of said last named means being connected to an audio output so that said housing vibrates in response to the signal received from said audio output while the sounds from said speaker are muffled, and the rim of said speaker is disposed at about a right angle to said base so that said speaker faces upwardly within said housing.

2. A device for providing a pleasurable sensation when it is touched comprising a base, an audio speaker and a housing, said speaker including a circular rim comprised of rigid material, said housing comprising a hollow sphere supported on said base and completely enclosing said speaker with the entire periphery of said rim being in engagement with the wall of said housing to enable said housing to support said speaker and to enable the vibrations of said speaker to be transmitted to said wall to vibrate said wall, said wall being of sufficient thickness to muffle the sounds emanating from said speaker, an aperture in said wall, means for energizing said speaker, a portion of said last named means extending through said aperture and being in electrical connection with said speaker, another portion of said last named means being connected to an audio output so that said housing vibrates in response to the signal received from said audio output while the sounds from said speaker are muffled, and said rim of said speaker is disposed at about a 45° angle to said base so that said speaker faces upwardly and to the side within said housing.

3. A device for providing a pleasurable sensation when it is touched comprising a base, an audio speaker and a housing, said speaker including a circular rim comprised of rigid material, said housing comprising a hollow sphere supported on said base and completely enclosing said speaker with the entire periphery of said rim being in engagement with the wall of said housing to enable said housing to support said speaker and to enable the vibrations of said speaker to be transmitted to said wall to vibrate said wall, said wall being of sufficient thickness to muffle the sounds emanating from said speaker, an aperture in said wall, means for energizing said speaker, a portion of said last named means extending through said aperture and being in electrical connection with said speaker, another portion of said last named means being connected to an audio output so that said housing vibrates in response to the signal received from said audio output while the sounds from said speaker are muffled, and said housing is generally egg shaped.

4. A device for providing a pleasurable sensation when it is touched comprising a base, an audio speaker and a housing, said speaker including a rectangular rim comprised of rigid material, said housing comprising a hollow sphere supported on said base and completely enclosing said speaker with the corners of said rim being in engagement with the wall of said housing to enable said housing to support said speaker and to enable the vibrations of said speaker to be transmitted to said wall to vibrate said wall, said wall being of sufficient thickness to muffle the sounds emanating from said speaker, an aperture in said wall, means for energizing said speaker, a portion of said last named means extending through said aperture and being in electrical connection with said speaker, another portion of said last named means being connected to an audio output so that said housing vibrates in response to the signal received from said audio output while the sounds from said speaker are muffled, and the rim of said speaker is disposed at about a right angle to said base so that said speaker faces upwardly within said housing.

5. A device for providing a pleasurable sensation when it is touched comprising a base, an audio speaker and a housing, said speaker including a rectangular rim comprised of rigid material, said housing comprising a hollow sphere supported on said base and completely enclosing said speaker with the corners of said rim being in engagement with the wall of said housing to enable said housing to support said speaker and to enable the vibrations of said speaker to be transmitted to said wall to vibrate said wall, said wall being of sufficient thickness to muffle the sounds emanating from said speaker, an aperture in said wall, means for energizing said speaker, a portion of said last named means extending through said aperture and being in electrical connection with said speaker, another portion of said last named means being connected to an audio output so that said housing vibrates in response to the signal received from said audio output while the sounds from said speaker are muffled, and said rim of said speaker is disposed at about a 45° angle to said base so that said speaker faces upwardly and to the side within said speaker.

* * * * *

UNITED STATES PATENT OFFICE

CERTIFICATE OF CORRECTION

PATENT NO. : 4,175,552

DATED : November 27, 1979

INVENTOR(S) : Brian G. Johnson

It is certified that error appears in the above-identified patent and that said Letters Patent are hereby corrected as shown below:

Claim 5, the last line; change "speaker" to --housing--.

Signed and Sealed this

*First* Day of *April 1980*

[SEAL]

*Attest:*

SIDNEY A. DIAMOND

*Attesting Officer*

*Commissioner of Patents and Trademarks*